US006698298B2

(12) United States Patent
Tsuji et al.

(10) Patent No.: US 6,698,298 B2
(45) Date of Patent: Mar. 2, 2004

(54) TORQUE WRENCH FOR FURTHER TIGHTENING INSPECTION

(75) Inventors: Hiroshi Tsuji, Tokyo (JP); Nobuyoshi Kobayashi, Tokyo (JP)

(73) Assignee: Tohnichi MFG. Co., Ltd., Tokyo (JP)

( * ) Notice: Subject to any disclaimer, the term of this patent is extended or adjusted under 35 U.S.C. 154(b) by 0 days.

(21) Appl. No.: 10/089,241

(22) PCT Filed: Jun. 18, 2001

(86) PCT No.: PCT/JP01/05164

§ 371 (c)(1),
(2), (4) Date: May 2, 2002

(87) PCT Pub. No.: WO02/11953

PCT Pub. Date: Feb. 14, 2002

(65) Prior Publication Data

US 2002/0152820 A1 Oct. 24, 2002

(51) Int. Cl.[7] ..... G10L 5/24
(52) U.S. Cl. ..... 73/862.21
(58) Field of Search ..... 73/761, 862.23, 73/862.21, 862.22; 29/407

(56) References Cited

U.S. PATENT DOCUMENTS 4,235,006 A * 11/1980 Eshghy ..... 29/407.02
4,375,122 A * 3/1983 Sigmund ..... 29/407.02
4,375,123 A * 3/1983 Ney ..... 29/407.02

FOREIGN PATENT DOCUMENTS

| | | |
|---|---|---|
| JP | 51-119275 | 10/1976 |
| JP | 6-137975 | 5/1994 |
| JP | 9-174451 | 7/1997 |
| JP | 2000-778 | 1/2000 |
| JP | 2000-94355 | 4/2000 |

* cited by examiner

*Primary Examiner*—Edward Lefkowitz
*Assistant Examiner*—Jewel V. Thompson
(74) *Attorney, Agent, or Firm*—Kanesaka & Takeuchi

(57) ABSTRACT

A torque wrench for additional tightening inspection can measure a precise torque value by simply tightening the tightening bolt additionally. When the inspection bolt is tightened, the rotation of the wrench is detected before the rotation of the bolt due to the torsion of the wrench itself. The intersection P between a torque gradient line M obtained at that time and a torque gradient line N of a rotating state after the rotation of the bolt makes a measuring point. The torque value at this intersection P is determined to obtain a torque measurement. Here, the torque gradient line N is obtained by connecting several points each corresponding to a torque value of 90% of the torque value TA at the intersection PA with a referential torsional torque gradient line L.

8 Claims, 6 Drawing Sheets

TORQUE WRENCH FOR FURTHER TIGHTENING INSPECTION

TECHNICAL FIELD

The present invention relates to a torque wrench for additional tightening inspection.

BACKGROUND ART

Among inspection methods for inspecting a tightened bolt (screw) for a torque value, there is an additional tightening torque method in which the bolt in the tightened state is further tightened with a torque wrench and the torque value at which the bolt starts rotating again is read from the above-mentioned torque wrench. Incidentally, the bolt is left as it is after the inspection.

This additional tightening torque method uses such torque wrenches as a scaled torque wrench. Upon the restart of rotation, the torque value is read from the scale to check the tightening torque value of the bolt.

In this additional tightening torque method of checking the tightening torque value of a tightening bolt by using a scaled torque wrench, as shown in FIG. 5, a force in the tightening direction is applied to the torque wrench, and the bolt to be inspected (hereinafter, referred to as inspection bolt) undergoes a torque. The torque increases as shown by the broken line E.

On the other hand, in order for the inspection bolt in a stationary state to be rotated again, a torque must be applied beyond the one resulting from the static frictional resistance of the inspection bolt. Accordingly, when the tightening torque increases as shown by the broken line E to exceed the point A and the integral rotation of the torque wrench and the inspection bolt is sensed and confirmed at an additional tightening point B, the additional tightening torque measurement $T_2$ corresponding to that point is read from the scale on the torque wrench. Based on this additional tightening torque measurement $T_2$, the torque value ($T_1$) at the point A is calculated, for example, by using a predetermined factor. Then, it is determined if this torque value $T_1$ calculated equals to a desired torque value ($T_0$) specified.

In such a conventional additional tightening torque method, the additional tightening torque measurement $T_2$ has a difference in value with respect to the actual tightening torque value $T_1$. Besides, the torque measurement in additional tightening at the foregoing additional tightening point B may vary. For example, when the bearing surfaces of the tightening bolt and the member to be tightened by the tightening bolt are in close contact, the additional tightening point B rises in torque indicating position on the characteristic chart of FIG. 5. This causes an increase in the additional tightening torque measurement $T_2$.

When lubricating oil, a washer, or the like is interposed between the bearing surfaces of the member to be tightened and the tightening bolt so that the member to be tightened and the tightening bolt are in loose contact, the additional tightening point B falls in torque indicating position. The additional tightening torque measurement $T_2$ then approaches the tightening torque value $T_1$.

In addition, the torque indicating position of the additional tightening point B also fluctuates up and down due to variations in the rotational speed of the torque wrench depending on persons to be measured, the degrees of thermal expansion of the member to be tightened and the tightening bolt depending on air temperature, and so on. These factors also cause variations in the torque measurement $T_2$ in additional tightening.

For this reason, the present applicant has already proposed the invention described in Japanese Patent Laid-Open Publication No. 2000-778 as a method of measuring a tightening torque which resolves such variations in the measurement $T_2$.

This method of measuring a tightening torque is based on the assumption that in FIG. 5, when tightening is started and a stable rotating state is reached beyond the point A where the inspection bolt starts rotating again, the rotation angle and the torque value of the inspection bolt (torque wrench, in fact) trace a linear characteristic line and this characteristic line crosses the point A. At and after the point C where the rotating state is stable, the torque value corresponding to a rotation angle of the torque wrench is measured on a plurality of points. The measurement start position ($\theta_0$) of the rotation angle is set at the point A so that the torque value at the point A can be obtained by calculation.

DISCLOSURE OF THE INVENTION

The torque wrench for additional tightening inspection described above, capable of measuring the rotation angle of the torque wrench to inspect the tightening torque, is based on the theory assuming that the rotation angle of the torque wrench is 0° until the point A shown in FIG. 5 is exceeded.

Nevertheless, it is impossible for the entire torque wrench including the torque wrench body and the socket to be made into a perfect rigid body. For example, when a force is applied to the torque wrench, the torque wrench itself bends because of distortion. It follows that a certain angle of rotation is detected before the point A shown in FIG. 5 is reached.

Moreover, torque wrenches to be used for measuring a tightening torque by applying an additional tightening torque to a tightening bolt already tightened as described above vary greatly in type and characteristic.

For example, in a torque wrench such as a torque wrench for additional tightening inspection shown in FIG. 1, as an embodiment of the invention, a wrench body 2 is provided with torque detecting means and a processor 1 including a display unit for displaying the torque value detected, and is selectively combined with ratchet type replaceable heads 3, spanner type replaceable heads 4, various kinds of sockets of different lengths (not shown), or the like to measure a tightening screw for a screw tightening torque. Here, variations in the torsion angles and play angles inherent to the above-mentioned attachments to be selected in use, or the various kinds of replaceable heads and sockets, cause differences in the torsion angle characteristics and play angle characteristics of the respective measuring wrenches in use.

For example, the maker side of the torque wrench ships to the user side a predetermined wrench body 2 and attachments specified by a predetermined torsion characteristic or the like in combination as intended for the measurement of the tightening torque of a tightening screw. When the user measures the tightening torque of a tightening screw, any change will not occur in the characteristic of the wrench and the tightening torque value can be easily detected (measured) on the basis of the torsion characteristic of the torque wrench specified at the time of the shipment so long as the attachments are combined and used with the wrench body 2 as they are shipped from the maker. Depending on the working environment and the like for the tightening torque measurement, however, attachments other than those shipped might have to be substituted and used with the wrench body in measurement from sheer necessity.

In such cases, a difference can occur between the torsion characteristic etc. of the attachments substituted and used by the measurer to measure the tightening screw torque value and the torsion characteristic of the attachments mounted on the wrench body upon the shipment from the maker. Then, as shown in FIG. 6, for example, the torque wrench may start rotating at the rotation start point $\theta_0$ before the inspection bolt actually starts rotation, thereby causing a difference in angle from the rotation start position $\theta_1$ where the inspection bolt actually rotates again (starts additional tightening).

Consequently, an error Ts appeared in the torque value calculated corresponding to this difference in angle, and it was impossible to obtain a tightening torque value with high precision.

An object of the invention according to the present application is to provide a torque wrench for additional tightening inspection which corrects an error resulting from the rotation of a torque wrench before the rotation of an inspection bolt so that a tightening torque of the bolt can be obtained with precision by simply tightening the tightening bolt additionally.

A first invention is a torque wrench for additional tightening inspection for tightening a bolt in a tightened state, comprising: torque detecting means for detecting a torque in tightening the bolt, the torque detecting means being arranged in a wrench body; rotation angle detecting means for detecting a rotation angle of the torque wrench, the rotation angle detecting means being arranged in the wrench body; first arithmetic means for assuming a torque gradient line in a rotating state of the bolt based on input information acquired in a stable domain after the rotation of the bolt and a referential torsion characteristic gradient line set in advance, with torque information detected by the torque detecting means and the rotation angle detected by the rotation angle detecting means as the input information; second arithmetic means for assuming a torque gradient line in a stationary state of the bolt obtained from the input information before the rotation of the bolt; and third arithmetic means for determining an intersection between the torque gradient line in the rotating state obtained by the first arithmetic means and the torque gradient line in the stationary state obtained by the second arithmetic means, and determining a torque value at the intersection as a torque measurement.

A second invention is a torque wrench for additional tightening inspection for tightening a bolt in a tightened state, comprising: torque detecting means for detecting a torque in tightening the bolt, the torque detecting means being arranged in a wrench body; rotation angle detecting means for detecting a rotation angle of the torque wrench, the rotation angle detecting means being arranged in the wrench body; first arithmetic means for assuming a torque gradient line in a rotating state of the bolt based on input information acquired in a stable domain after the rotation of the bolt and a referential torsion characteristic gradient line set in advance, with torque information detected by the torque detecting means and the rotation angle detected by the rotation angle detecting means as the input information; second arithmetic means for assuming a torque gradient line in a stationary state of the bolt obtained from the input information before the rotation of the bolt; and third arithmetic means for determining, as a torque measurement, a torque value at an intersection between the torque gradient line in the rotating state of the bolt obtained by the first arithmetic means and the referential torsion characteristic gradient line when a number of pieces of the input information for arithmetic in the second arithmetic means falls below a number set in advance.

A third invention is either one of the foregoing inventions, characterized by comprising display means for displaying the torque measurement determined by the third arithmetic means.

A fourth invention is the foregoing first or second invention, characterized by comprising informing means for informing of the completion of measurement when a rotation beyond an angle set in advance is made after the rotation of the bolt.

A fifth invention is any one of the foregoing inventions, characterized in that the first arithmetic means uses the input information acquired in a domain beyond a predetermined rotation angle after the rotation of the bolt as the input information obtained in the stable domain.

A sixth invention is any one of the foregoing inventions, characterized in that the first arithmetic means determines an intersection between a torque gradient line obtained from the input information acquired in the stable domain after the rotation of the bolt and the referential torsion characteristic gradient line set in advance, and further assumes a torque gradient line in the rotating state of the bolt with a torque value obtained by multiplying a torque value at the intersection by a predetermined factor as an intersection.

BEST MODE FOR CARRYING OUT THE INVENTION

Figure 1:
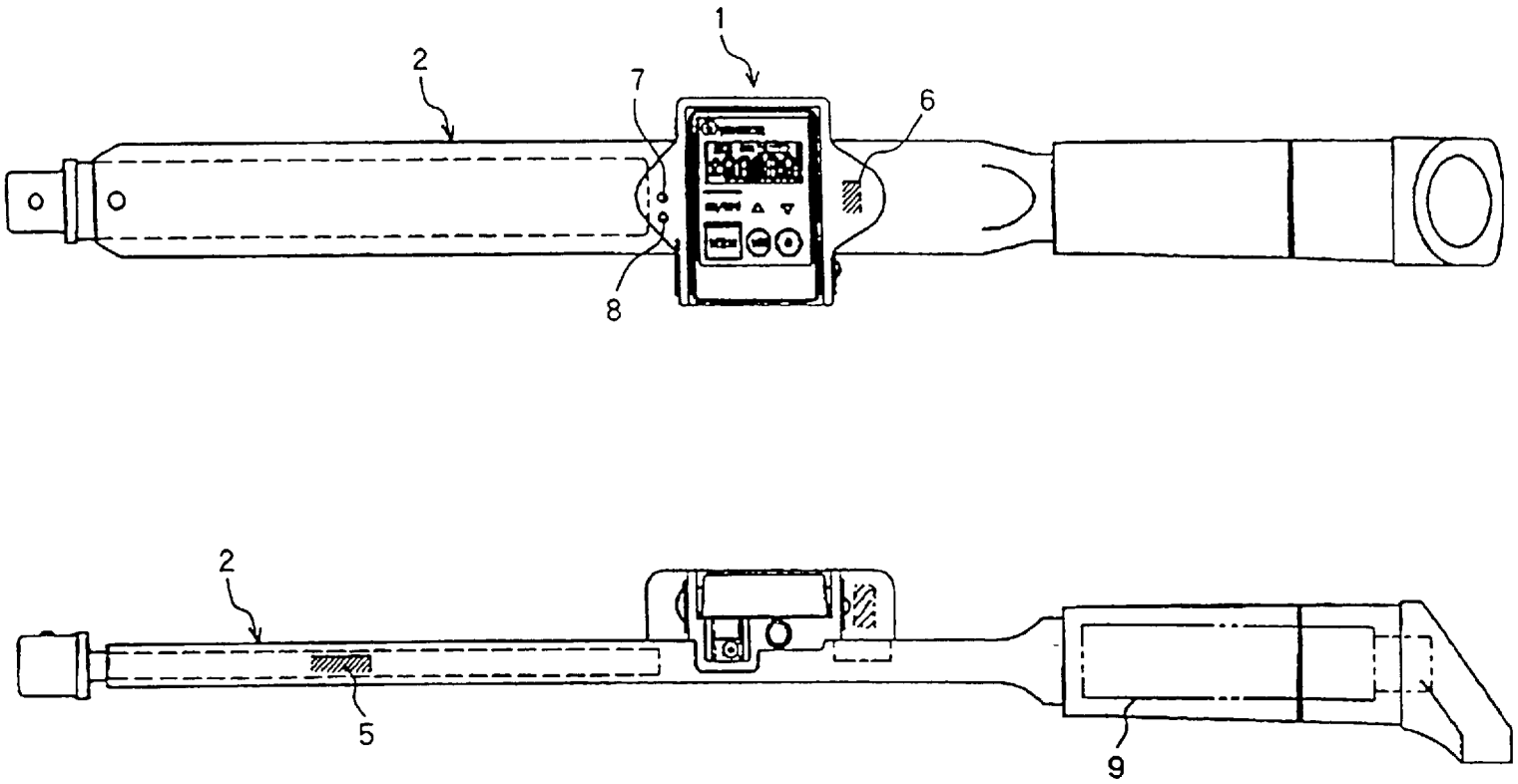
FIG. 1 is an external view showing an embodiment of a torque wrench for additional tightening inspection of the present invention.

Hereinafter, the present invention will be described in detail in conjunction with an embodiment shown in the drawings.

Figure 2:
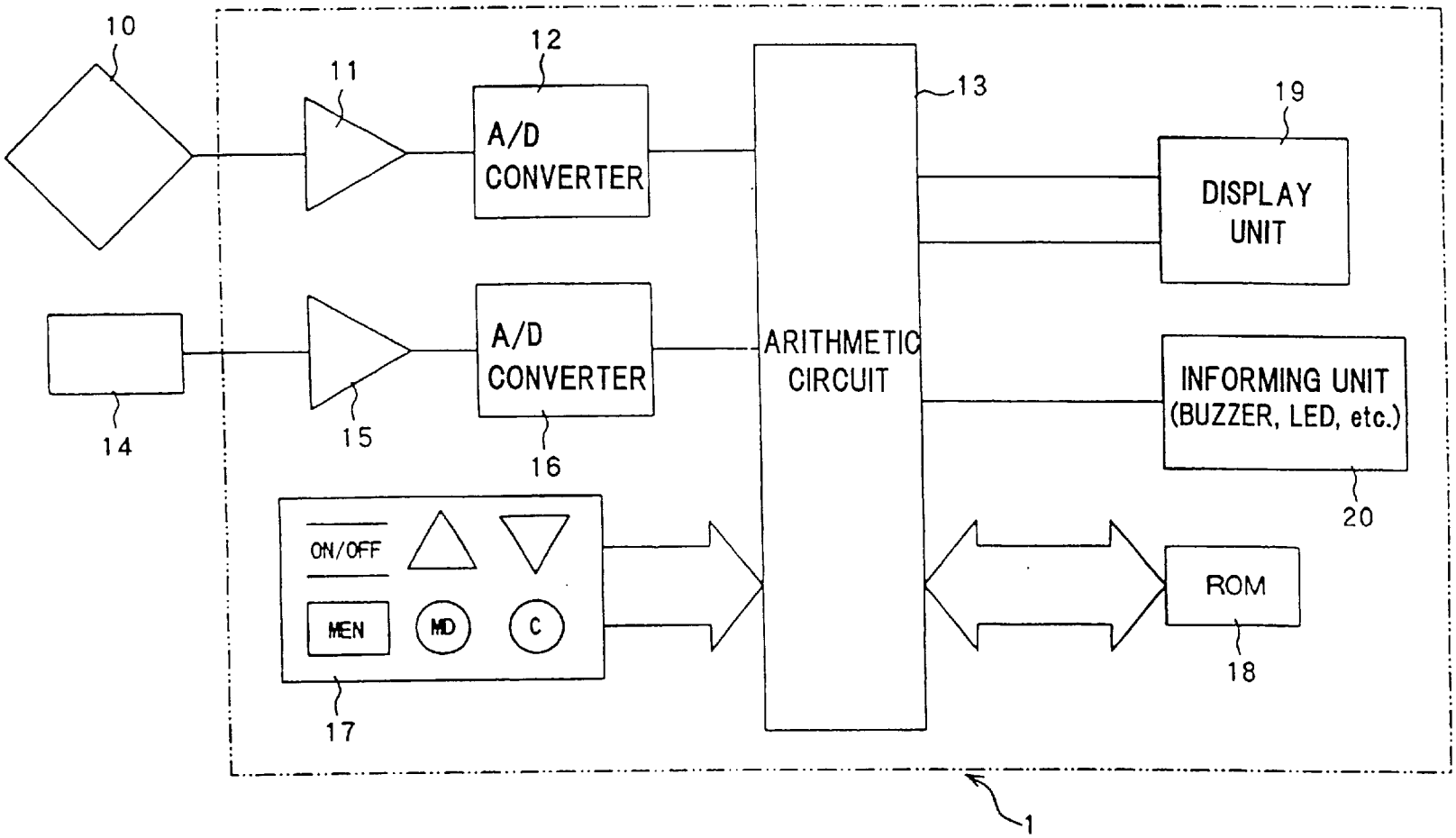
FIG. 2 is a block diagram of a processing circuitry of FIG. 1.
Figure 3:
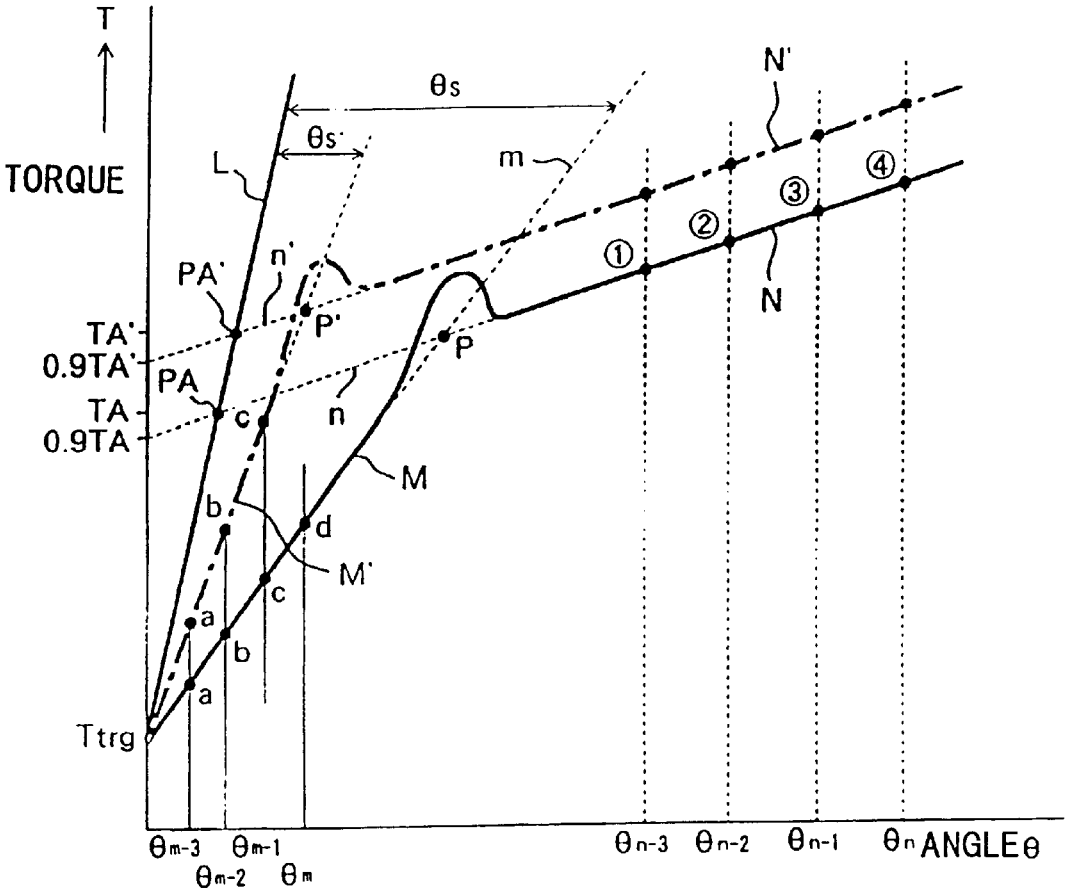
FIG. 3 is a chart showing an arithmetic processing of tightening torque values determined by the processor of FIG. 2.
Figure 4:
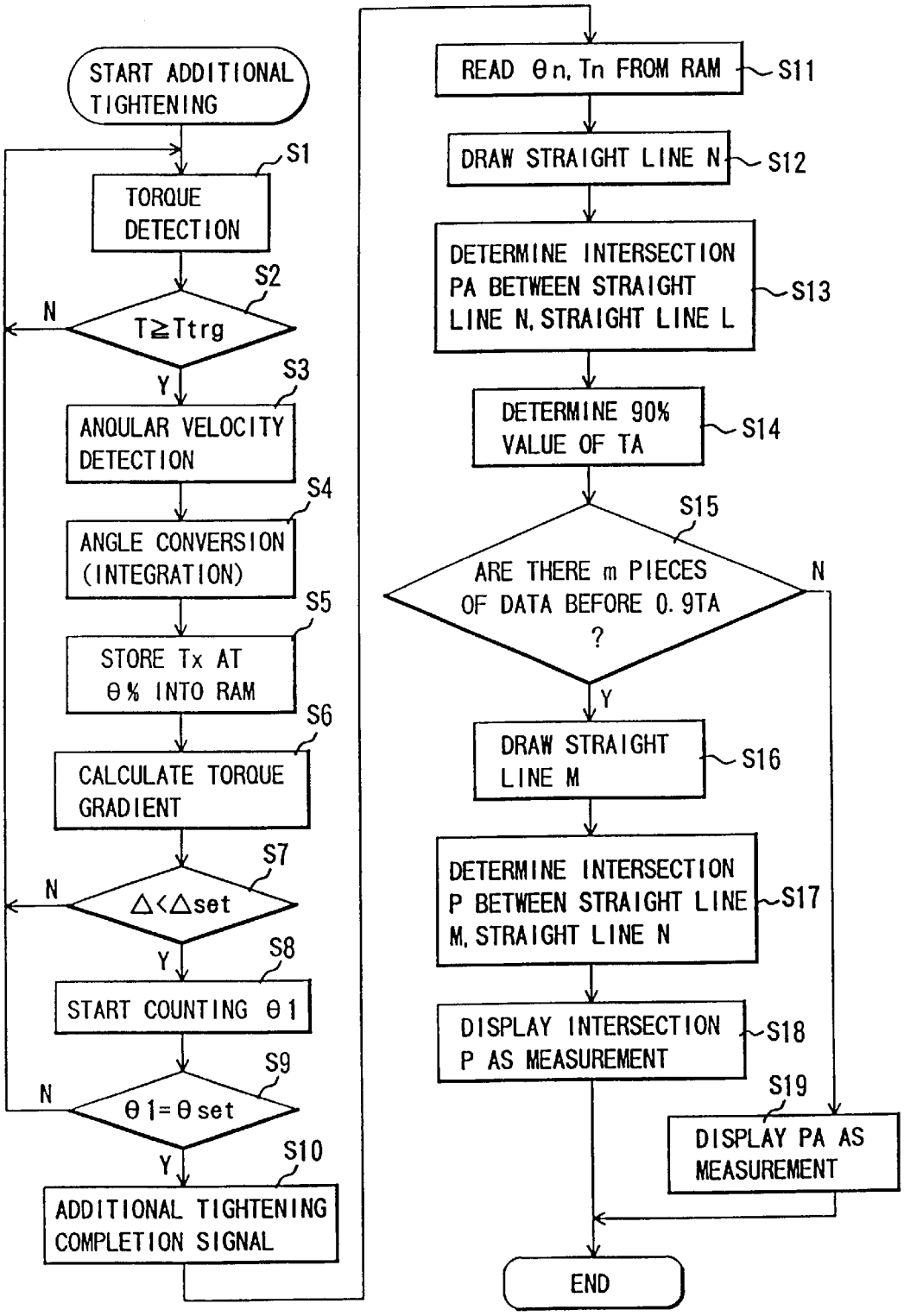
FIG. 4 is a flowchart for showing the operation of the arithmetic circuit of FIG. 2.
Figure 5:
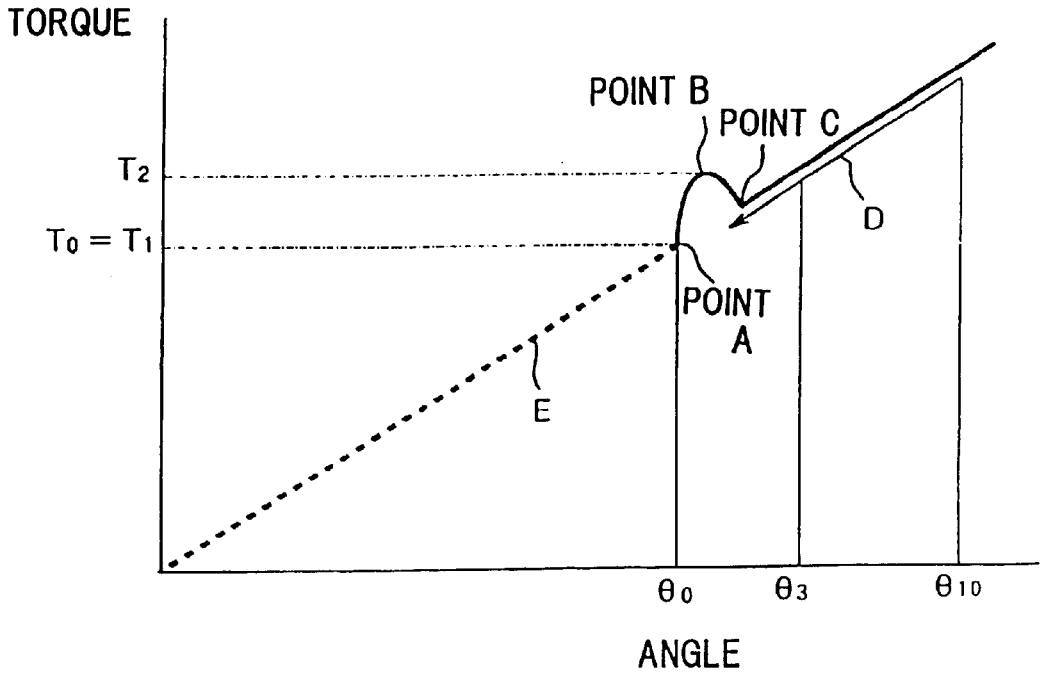
FIG. 5 is a characteristic chart showing the relationship between the tightening torque and the torsion angle in an ordinary wrench.
Figure 6:
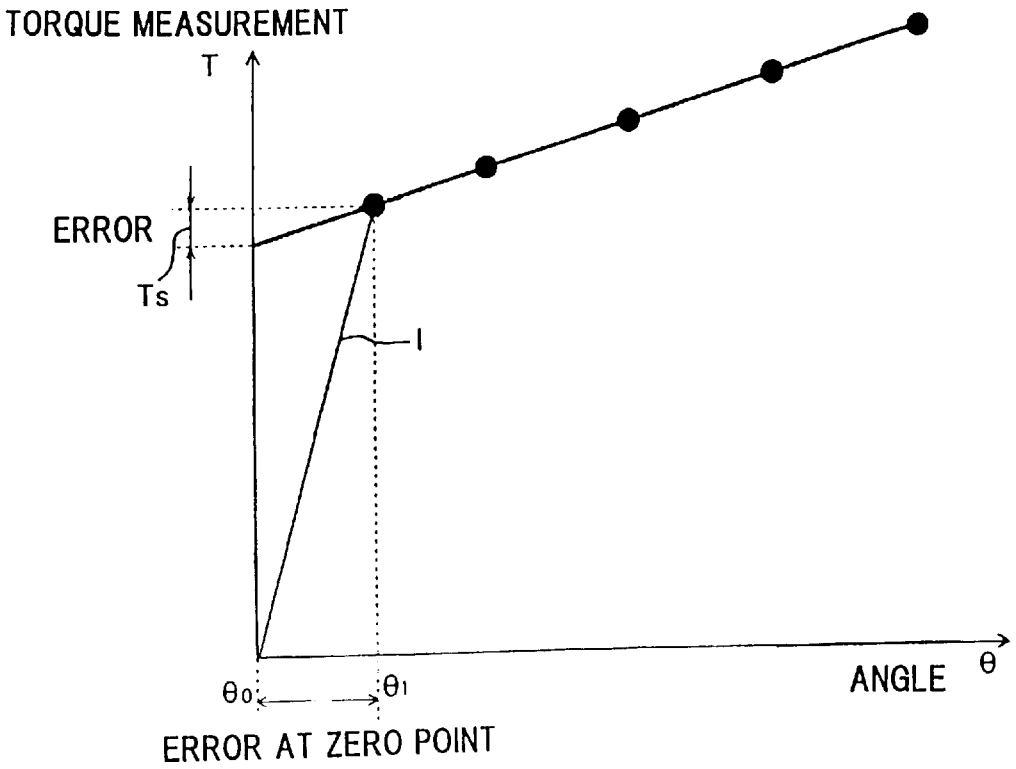
FIG. 6 is a characteristic chart showing the occurrence of an error from torsion.

FIG. 1 is an external view of a torque wrench for additional tightening inspection, showing an embodiment of the present invention. FIG. 2 is a block diagram showing an electric circuitry of a processor arranged in the torque wrench of FIG. 1. FIG. 3 is a chart showing the arithmetic processing of tightening torque values to be obtained by the processor of FIG. 2. FIG. 4 is a flowchart showing the operation of the processor of FIG. 2.

In the torque wrench for additional tightening inspection shown in FIG. 1, desired ratchet type replaceable heads, spanner type replaceable heads, not-shown ordinary length sockets, long sockets, or the like can be replaced and used with a torque wrench body 2.

The torque wrench body 2 is provided with torque detecting means 5 such as a distortion gauge and rotation angle detecting means 6 such as an oscillating type gyro sensor for detecting the rotation angle of the torque wrench when the torque wrench body 2 is rotated to tighten a bolt. The torque wrench body 2 is also provided with a processor 1 which calculates a tightening torque based on detection information from the torque detecting means 5 and the rotation angle detecting means 6 and has a display unit for displaying the tightening torque determined by the calculation.

Incidentally, 7 represents a buzzer, 8 an LED, and 9 a rechargeable cell as the power supply of the processor 1 and others.

The processor 1 shown in FIG. 2 outputs a detection signal, or a torque detection value from a distortion gauge 10 serving as the torque detecting means, to an amplifying circuit 11 so that it is digitized by an A/D converter 12 and input to an arithmetic circuit 13.

In the meantime, an oscillating type gyro sensor 14 serving as the angle detecting means inputs an angular velocity detected during the additional tightening of the bolt to an amplifying circuit 15 so that it is digitized by an A/D converter 16 and input to the arithmetic circuit 13. The arithmetic circuit 13 integrates the input angular velocity into the rotation angle (θ) of the torque wrench.

In addition, the arithmetic circuit 13 stores the torque values and rotation angle values mentioned above into a not-shown RAM in association with each other, and displays the result of calculation obtained from the values stored in the RAM onto a display unit 19 which consists of a liquid crystal display panel or the like. Incidentally, the actual angle for an inspection bolt to be rotated by in order to perform the additional tightening of the inspection bolt is of the order of several degrees (3°, in the present embodiment). There is also provided an informing unit 20 which informs by a buzzer sound, LED light, or the like that the rotation of the torque wrench for the additional tightening is no longer necessary when the rotation angle specified is exceeded.

The arithmetic circuit 13 performs an operation for determining the tightening torque by tracing a characteristic line as shown in FIG. 3.

In FIG. 3, L represents a reference torsion angle characteristic line which shows the relationship between a torque T inherent to this torque wrench for additional tightening inspection and the rotation angle of the wrench. This reference torsion angle characteristic line is previously stored in a ROM 18. Here, Ttrg shows a torque necessary to remove the backlash of the sockets or the like. For example, when the additional tightening is started using a long socket, the torque wrench rotates as shown by a characteristic line M due to flexure of the torque wrench even though the inspection bolt is not rotated. These rotation angles and torque values are stored into the RAM.

Then, when the inspection bolt is rotated actually, the rotation angle and the torque value undergo the relationship of slightly nonlinear state with each other before the rotation angle and the torque value change along the linear characteristic line N which traces when in a rotating state. Incidentally, it was confirmed from experiments that the rotation angle sufficient for an inspection bolt to start rotation and go through the nonlinear state, in which the relationship between the rotation angle and the torque value is unstable, was around 1.5 degrees.

In the present embodiment, the torque values corresponding to the rotation angles at positions rotated in units of 0.5° ($\theta_{n-2}$, $\theta_{n-1}$, $\theta_n$) from $\theta_{n-3}$ are stored into the ROM 18, where $\theta_{n-3}$ is the position rotated by 1.5 degrees after the inspection bolt actually start rotation. That is, data shall be acquired on four points ①, ②, ③, and ④ within the range of 1.5 degrees.

These points ① to ④ are connected to obtain the characteristic line N, a straight line. This characteristic line N is further extended to the reference torsion angle characteristic line L. The intersection will be referred to as PA. Here, it has been confirmed from experiments that a torque value corresponding to the rotation angle of the torque wrench rotated due to its own flexure and the like before the inspection bolt actually starts rotation is around 0.9 that of the reference torsion angle characteristic line L. Therefore, the value at the point 0.9TA, or 0.9 times the torque value TA corresponding to the point PA, is determined.

Here, the rotation angle needed for the torsion of the torque wrench has a linear relationship with the torque value. As a matter of course, the point where the inspection bolt actually starts rotation also holds this relationship.

Therefore, it is checked if the RAM contains torque values on a plurality of points (four points, in the present embodiment) which are smaller than the torque value 0.9TA. In the present embodiment, torque values shall be stored for the positions at regular intervals of, e.g., 0.2° in rotation angle ($\theta_{m-3}$, $\theta_{m-2}$, $\theta_{m-1}$, $\theta_m$). This means four points, and these four points (a, b, c, and d) are connected to obtain the characteristic line M. Then, this characteristic line M is extended to determine the intersection with the foregoing characteristic line N. This intersection P shows the angle where the inspection bolt actually starts rotation.

Since the intersection P lies on the characteristic line N, the torque value TP at the intersection P also shows. This torque value TP is displayed on the display unit 19 as the torque measurement for inspecting the tightening torque.

Next, when an ordinary socket (short socket) is used for additional tightening, the torsion of the socket itself is smaller than in the case of the long socket described above. As compared to the torsion characteristic line M of the long socket, the torsion characteristic line M' of the short socket has a smaller torsion difference θs' from the reference torsion angle characteristic line L (θs>θs'). Therefore, the inspection bolt actually starts rotation at a smaller torsion than with the long socket.

Here, torque values smaller than the torsion-needed torque value 0.9TA' determined based on the referential torsion angle characteristic line L are stored into the RAM as in the case described above, but for three points alone. This might possibly deteriorate the precision of the angular position of the intersection P' between the torsion characteristic line M' and a characteristic line N'.

Nevertheless, in this case, the torsion difference θs' of the torsion characteristic line M' with respect to the reference torsion angle characteristic line L is small. Then, there may occur little problem even if the intersection PA' between the characteristic line N' and the reference torsion angle characteristic line L is regarded as the point where the inspection bolt actually starts rotation.

Consequently, the torque value TA' corresponding to this intersection PA' is displayed on the display unit 19 as the torque measurement for inspecting the tightening torque.

In the present embodiment, the main switch of an operating unit 17 composed of operation switches and the like is turned ON to activate each circuit component such as the arithmetic circuit 13, thereby calculating a measurement according to a flowchart shown in FIG. 4.

When the additional tightening operation is started, a torque value is calculated based on the detection information input from the distortion gauge 10 through the A/D converter 12 (S1).

At S2, the current torque value T is compared with a preset torque Ttrg which is necessary for removing a backlash in the socket or the like. If the former is greater than the latter, the process proceeds to S3.

At S3, an angular velocity is determined based on the detection information input from the oscillating type gyro sensor 14 through the A/D converter 16. Then, the process proceeds to S4.

At S4, the angular velocity determined at S3 is integrated to obtain the rotation angle of the torque wrench. The process proceeds to S5.

At S5, the torque Tx corresponding to an arbitrary angle θx is stored into the RAM. The process proceeds to S6.

At S6, a torque gradient (Δ) per unit angle is calculated, and the process proceeds to S7.

At S7, it is decided if the torque gradient (Δ) is greater than a preset value (Δset). If it is smaller, the inspection bolt is regard as it has started rotation, and the process proceeds to S8.

At S8, counting the rotation angle of the inspection bolt is started. Then, the process proceeds to S9.

At S9, it is decided if the rotation angle reaches a preset angle (θset). If it is determined to reach, the process proceeds to S10. Incidentally, the present embodiment employs the setting of θset=3°.

At S10, the operator is informed of the completion of the additional tightening by an additional tightening completion signal, or by the buzzer and the LED. The process proceeds to S11.

At S11, θx and Tx stored in the RAM are read. The process proceeds to S12.

At S12, the straight line N shown in FIG. 3 is drawn from data (points ① to ④) in a certain stable domain before the completion of the additional tightening (in the present embodiment, between 1.5° and 3° after the rotation of the inspection bolt). The process proceeds to S13.

At S13, determined is the intersection PA between the pre-stored characteristic line L shown in FIG. 3 and the characteristic line N obtained at S12. Then, the process proceeds to S14.

At S14, a 90% value of the torque value TA corresponding to the point PA determined at S13 is determined, and the process proceeds to S15.

At S15, it is decided if m or more pieces of data necessary to draw the characteristic line M exist before 0.9TA. If it exists, the process proceeds to S16.

At S16, the straight characteristic line M is drawn from the data (a, b, c, d). Go to S17.

At S17, the intersection P between the straight characteristic line M and the straight linear characteristic line N is determined. The process proceeds to S18.

At S18, the torque value at the intersection P determined at S17 is displayed on the display unit 19 as the torque value at the measuring point. Then, this routine is ended for additional tightening operation.

On the other hand, at S15, if m or more pieces of data necessary to draw the characteristic line M do not exist, the process proceeds to S19.

At S19, the torque value at the intersection PA on the characteristic line L determined at S13 is displayed on the display unit 19 as the measuring point as shown in FIG. 3. Then, this routine for additional tightening operation is ended.

Next, the torque wrench for additional tightening inspection used in the present embodiment had a measuring range of 20–100 N·m. The used socket was 150 mm in length, 15 mm in the minimum diameter, and approximately 2.4 degrees in socket torsion under a load of 100 N·m. As for the bolts to be measured, ones of ordinary torque ascending rates were used, including one ascending by 0.56 N·m per degree under 20 N·m, one ascending by 1.39 N·m per degree under 50 N·m, and one ascending by 2.78 N·m per degree under 100 N·m.

For measurement under 20 N·m:

The straight line M shown in FIG. 3 could not be drawn. The straight line L was used without problems since the error calculated from the straight line L was as small as below 1% (0.75%).

For measurement under 50 N·m:

The error calculated from the straight line M shown in FIG. 3 was 0%, while the error calculated from the straight line L was as large as approximately 3%. The straight line M had to be used.

For measurement under 100 N·m:

The error calculated from the straight line M shown in FIG. 3 was 0%, while the error calculated from the straight line L was as large as approximately 7.1%. The straight line M had to be used.

As described above, according to the torque wrench for additional tightening inspection of the present embodiment, torque measurements can be obtained with consideration given to the fact that various kinds of sockets and the like are replaced in use and the torque wrench rotates before the actual rotation of the inspection bolt due to the torsion characteristics of the sockets and the like and the elastic deformation of the wrench itself. Therefore, whether or not the inspection bolt is tightened under a predetermined torque can be determined with high precision and rapidity.

Incidentally, in the embodiment described above, the processing circuitry is arranged on the torque wrench body whereas it may be arranged separately. The information detected by the distortion gauge and the oscillating type gyro sensor may be input to the processing circuitry by wires or wireless means.

INDUSTRIAL APPLICABILITY

As has been described, according to the present invention, even if the rotation of the torque wrench is being detected before the inspection bolt starts rotation, the error resulting from the rotation of the torque wrench before the rotation of the inspection bolt is corrected. The tightening bolt can be simply tightened additionally to obtain the torque measurement of the inspection bolt with precision and ease.

What is claimed is:

1. A torque wrench for additional tightening inspection for tightening a bolt in a tightened state, comprising:

a wrench body;

torque detecting means for detecting a torque in tightening said bolt, said torque detecting means being arranged in the wrench body;

rotation angle detecting means for detecting a rotation angle of the wrench body, said rotation angle detecting means being arranged in said wrench body;

first arithmetic means for assuming a torque gradient line in a rotating state of said bolt based on input information acquired in a stable domain after rotation of said bolt in the tightened state by the wrench body and a referential torsion characteristic gradient line set in advance, said input information being torque information detected by said torque detecting means and the rotation angle detected by said rotation angle detecting means;

second arithmetic means for assuming a torque gradient line in a stationary state of said bolt obtained from said input information before the rotation of said bolt; and third arithmetic means for determining an intersection between the torque gradient line in the rotating state obtained by said first arithmetic means and the torque gradient line in the stationary state obtained by said second arithmetic means, and determining a torque value at the intersection as a torque measurement.

2. A torque wrench for additional tightening inspection for tightening a bolt in a tightened state, comprising:

a wrench body;

torque detecting means for detecting a torque in tightening said bolt, said torque detecting means being arranged in the wrench body;

rotation angle detecting means for detecting a rotation angle of the wrench body, said rotation angle detecting means being arranged in said wrench body;

first arithmetic means for assuming a torque gradient line in a rotating state of said bolt based on input information acquired in a stable domain after rotation of said bolt in the tightened state by the wrench body and a referential torsion characteristic gradient line set in advance, said input information being torque information detected by said torque detecting means and the rotation angle detected by said rotation angle detecting means;

second arithmetic means for assuming a torque gradient line in a stationary state of said bolt obtained from said input information before the rotation of said bolt; and third arithmetic means for determining, as a torque measurement, a torque value at an intersection between the torque gradient line in the rotating state of said bolt obtained by said first arithmetic means and the referential torsion characteristic gradient line when a number of pieces of said input information for arithmetic in said second arithmetic means falls below a number set in advance.

3. The torque wrench for additional tightening inspection according to claim 2, wherein said torque detecting means provides first and second sets of values after the bolt in the tightened state starts to rotate by the wrench body, said first set of values being obtained immediately after the bolt starts to rotate and being provided to the second arithmetic means to assume the torque gradient line in the stationary state, and said second set of values being obtained after the first set of values and provided to the first arithmetic means.

4. The torque wrench for additional tightening inspection according to claim 1, further comprising display means for displaying the torque measurement determined by said third arithmetic means.

5. The torque wrench for additional tightening inspection according to claim 1, further comprising informing means for informing of a completion of measurement when a rotation beyond an angle set in advance is made after the rotation of said bolt.

6. The torque wrench for additional tightening inspection according to claim 1, characterized in that wherein said first arithmetic means uses said input information acquired in a domain beyond a predetermined rotation angle after the rotation of said bolt as said input information obtained in said stable domain.

7. The torque wrench for additional tightening inspection according to claim 1, wherein said first arithmetic means determines an intersection between a torque gradient line obtained from said input information acquired in said stable domain after the rotation of said bolt and the referential torsion characteristic gradient line set in advance, and further assumes a torque gradient line in the rotating state of said bolt with a torque value obtained by multiplying a torque value at the intersection by a predetermined factor as an intersection.

8. The torque wrench for additional tightening inspection according to claim 1, wherein said torque detecting means provides first and second sets of values after the bolt in the tightened state starts to rotate by the wrench body, said first set of values being obtained immediately after the bolt starts to rotate and being provided to the second arithmetic means to assume the torque gradient line in the stationary state, and said second set of values being obtained after the first set of values and provided to the first arithmetic means.

* * * * *